US008748724B1

(12) United States Patent
Harmon

(10) Patent No.: US 8,748,724 B1
(45) Date of Patent: Jun. 10, 2014

(54) APPARATUS AND METHOD FOR GENERATING EFFECTS BASED ON AUDIO SIGNAL ANALYSIS

(76) Inventor: Michael G. Harmon, Murray, KY (US)

( * ) Notice: Subject to any disclaimer, the term of this patent is extended or adjusted under 35 U.S.C. 154(b) by 822 days.

(21) Appl. No.: 12/953,904

(22) Filed: Nov. 24, 2010

Related U.S. Application Data

(60) Provisional application No. 61/281,933, filed on Nov. 25, 2009.

(51) Int. Cl.
*G10H 1/02* (2006.01)
*G10H 1/32* (2006.01)
*G10H 3/00* (2006.01)

(52) U.S. Cl.
USPC ..... 84/737; 84/746

(58) Field of Classification Search
USPC ..... 84/737–742, 746
See application file for complete search history.

(56) References Cited

U.S. PATENT DOCUMENTS

| | | | | | |
|---|---|---|---|---|---|
| 3,530,224 | A * | 9/1970 | Kushner et al. | 84/742 |
| 3,911,776 | A | 10/1975 | Beigel | |
| 4,480,520 | A * | 11/1984 | Gold | 84/735 |
| 4,545,278 | A * | 10/1985 | Gagon et al. | 84/726 |
| 5,136,918 | A * | 8/1992 | Riboloff | 84/723 |
| 5,311,806 | A * | 5/1994 | Riboloff | 84/728 |
| 5,557,058 | A * | 9/1996 | Lace | 84/735 |
| 5,763,808 | A * | 6/1998 | Thomson | 84/728 |
| 5,780,760 | A * | 7/1998 | Riboloff | 84/726 |
| 5,866,834 | A * | 2/1999 | Burke et al. | 84/622 |
| 5,977,474 | A * | 11/1999 | O'Brien | 84/735 |
| 6,034,316 | A * | 3/2000 | Hoover | 84/738 |
| 6,791,023 | B2 * | 9/2004 | Nakaya | 84/736 |
| 6,888,057 | B2 * | 5/2005 | Juszkiewicz et al. | 84/645 |
| 7,271,332 | B2 * | 9/2007 | Clark | 84/736 |
| 7,304,232 | B1 * | 12/2007 | Nicholes | 84/741 |
| 7,420,112 | B2 * | 9/2008 | Juszkiewicz et al. | 84/600 |
| 7,952,014 | B2 * | 5/2011 | Juszkiewicz et al. | 84/742 |
| 7,982,125 | B2 * | 7/2011 | Takabayashi et al. | 84/731 |
| 8,084,681 | B2 * | 12/2011 | Schon | 84/746 |
| 2003/0052728 | A1 * | 3/2003 | Philpott | 327/385 |
| 2004/0069128 | A1 * | 4/2004 | Ludwig | 84/645 |
| 2004/0103776 | A1 * | 6/2004 | Juszkiewicz et al. | 84/742 |
| 2007/0131100 | A1 * | 6/2007 | Daniel | 84/737 |
| 2008/0034950 | A1 * | 2/2008 | Ambrosino | 84/742 |
| 2010/0195840 | A1 * | 8/2010 | Ciccone | 381/61 |
| 2013/0118340 | A1 * | 5/2013 | D'Amours | 84/746 |

* cited by examiner

*Primary Examiner* — Jeffrey Donels
(74) *Attorney, Agent, or Firm* — Middleton Reutlinger; Scott W. Higdon; John F. Salazar

(57) ABSTRACT

Inventive methods and apparatuses for causing one or more effects to be generated based on analysis of an audio signal are disclosed. The apparatuses may be electrically coupled to an audio signal, may analyze the audio signal to determine if a control cue is present in the audio signal, and direct the effects generated by one or more effect generating devices if a control cue is present.

19 Claims, 6 Drawing Sheets

APPARATUS AND METHOD FOR GENERATING EFFECTS BASED ON AUDIO SIGNAL ANALYSIS

CROSS-REFERENCE TO RELATED DOCUMENTS

This Application claims the benefit of Provisional Application Ser. No. 61/281,933 filed Nov. 25, 2009, which is hereby incorporated by reference in its entirety.

TECHNICAL FIELD

The present invention is directed generally to aspects of an apparatus for generating effects based on analysis of an audio signal. More particularly, various inventive methods and apparatus disclosed herein relate to one or more aspects of an apparatus that may be electrically coupled to an incoming audio signal and that directs the effects generated by one or more electrically coupled effect generating devices based on analysis of the incoming audio signal.

BACKGROUND

Certain effects often accompany a musical performance. For example, audio effects may be utilized to amplify, distort, or otherwise alter the sound of one or more instruments used in the musical performance. Also, for example, lighting effects may be utilized to highlight a performer, an area of the stage, and/or for dramatic effect during the musical performance. If an artist desires that one or more effects occur during the course of a musical performance, the artist may manually actuate a non-musical device to cause the effects to occur, may have someone else manually actuate a non-musical device to cause the effects to occur, or may time the effects to occur at certain points of the performance.

For example, a guitarist utilizing an effects pedal must manually step on a mechanical footswitch of the effects pedal to activate or deactivate the chorus effect thereof and must turn the potentiometers knobs thereof by hand to control the depth and/or rate parameters of the effects pedal. Accordingly, during a musical performance the musician has little control over the operating parameters of the existing audio effect systems other than controlling them with a nominally distracting footswitch or foot pedal or highly distracting rotation control knobs. Artist manual actuation of non-musical devices may present one or more drawbacks such as distractions from the performance. Having an additional person to manually actuate such devices may present one or more drawbacks such as distractions from the performance and/or costs. Timing the effects may present one or more drawbacks such as difficulty, inflexibility, and expense.

SUMMARY

The present disclosure is directed to inventive methods and apparatus for generating effects based on analysis of an audio signal, and, more specifically to one or more aspects of an apparatus that may be electrically coupled to an incoming audio signal and that directs the effects generated by one or more electrically coupled effect generating devices based on analysis of the incoming audio signal to determine if a control cue is present in the incoming audio signal.

Generally, in one aspect an effects pedal is provided that includes at least one audio signal input, a controller, and a sound effect circuit. The controller is electrically coupled to the audio signal input and includes a control effect signal output, at least one control cue, and at least one control effect signal correlated to the control cue. The sound effect circuit is electrically coupled to the at least one audio signal input and is electrically coupled to the control effect signal output. The sound effect circuit includes an audio signal output. The controller is operable to transform an audio signal received over the audio signal input into a frequency array, wherein the frequency array is indicative of frequency content of the audio signal over a period of time. The controller is further operable to identify a plurality of persistent frequencies present within the frequency array and analyze the persistent frequencies to determine if the control cue is present in the audio signal. The controller communicates the control effect signal over the control effect signal output in response to identification of the control cue. Communication of the control effect signal over the control effect signal output causes the sound effect circuit to manipulate at least one aspect of the audio signal and to output the manipulated audio signal to the audio signal output.

In some embodiments the control effect signal comprises a variable resistance.

In some embodiments the effects pedal further includes a potentiometer electrically interposed between the control effect signal output and the sound effect circuit, wherein a resistance of the potentiometer is dependent on the control effect signal.

In some embodiments the control effect signal comprises a variable digital output. In some embodiments the control effect signal comprises a variable voltage. In some versions of those embodiments the variable voltage may be generated by an analog to digital converter.

In some embodiments the at least one aspect of the audio signal includes the rate of the chorus of the audio signal.

In some embodiments the controller is operable to compare at least one later in time of the persistent frequencies to at least one earlier in time of the persistent frequencies to identify if the control cue is present in the audio signal. In some versions of those embodiments the control effect signal is dependent upon a magnitude difference between at least one later in time of the persistent frequencies and at least one earlier in time of the persistent frequencies. In some versions of those embodiments the extent of manipulation of the at least one aspect of the audio signal by the sound effect circuit is dependent on the magnitude difference between the at least one later in time of the persistent frequencies and the at least one earlier in time of the persistent frequencies.

In some embodiments the control cue includes at least a first frequency component. In some versions of those embodiments the control cue further includes a second frequency component.

In some embodiments the control cue includes a lack of frequency component.

Generally, in another aspect an effects pedal is provided that includes at least one audio signal input, a controller, and a sound effect circuit. The controller is electrically coupled to the audio signal input and includes at least one control effect signal output, at least one control cue, and at least one control effect signal correlated to the control cue. The control cue includes at least one frequency. The sound effect circuit is electrically coupled to the at least one audio signal input and is electrically coupled to the control effect signal output. The sound effect circuit includes an audio signal output. The controller is operable to analyze an audio signal received over the audio signal input to identify if the control cue is present in the audio signal. The controller communicates the control effect signal over the control effect signal output in response to identification of the control cue. Communication of the control effect signal over the control effect signal output causes the sound effect circuit to manipulate at least one aspect of the audio signal and to output the manipulated audio signal to the audio signal output. The manipulated at least one aspect of the audio signal includes at least one of rate and depth of the chorus of the audio signal.

In some embodiments the controller and the sound effect circuit are contained in a common electrical component.

In some embodiments the effects pedal further includes a user interface having at least a first position and a second position, wherein in the first position the first control effect signal is output over the control effect signal output in response to the control cue, and wherein in the second position a second control effect signal is output by the controller in response to at least one of the control cue and a second control cue of the at least one control cue. In some versions of those embodiments in the second position the second control effect signal is output over a second control effect signal output of the controller. The second control effect signal output is in electrical communication with the sound effect circuitry. In some versions of those embodiments communication of the second control effect signal over the second control effect signal output causes the sound effect circuit to manipulate a second aspect of the at least one aspect of the audio signal.

In some embodiments the effects pedal further includes a first digital potentiometer electrically interposed between the control effect signal output and the sound effect circuitry.

In some embodiments the effects pedal further includes a manually adjustable knob coupled to a manually adjustable potentiometer. The manually adjustable potentiometer is selectively electrically coupled to the sound effect circuitry to thereby enable manual manipulation of the audio signal. In some versions of those embodiments the effects pedal further includes a manually adjustable effects knob electrically coupled to the manually adjustable potentiometer and the sound effect circuitry. The manually adjustable effects knob selectively electrically disconnects the manually adjustable potentiometer from the sound effect circuitry.

Generally, in another aspect an effects pedal is provided that includes at least one audio signal input and a controller. The controller is electrically coupled to the audio signal input and includes at least one control effect signal output, at least one control cue, and at least one control effect signal correlated to the control cue. The control cue includes at least one frequency. The controller includes means for analyzing an audio signal received over the audio signal input to identify if the control cue is present in the audio signal. The controller communicates the control effect signal over the control effect signal output in response to identification of the control cue. Communication of the control effect signal over the control effect signal output causes means for manipulating an audio signal to manipulate at least one aspect of the audio signal and to output the manipulated audio signal to the audio signal output. The manipulated at least one aspect of the audio signal includes at least one of rate and depth of the chorus of the audio signal.

Generally, in another aspect a method for generating one or more effects based on musical audio signal analysis is provided. The method may include the following steps: receiving a musical audio signal generated by user actuation of an instrument; converting the musical audio signal into a predefined digital format audio signal; transforming the digital format audio signal into a frequency array, wherein the frequency array is indicative of frequency content of the audio signal over a period of time; identifying a plurality of persistent frequencies present within the frequency array; analyzing the persistent frequencies to identify at least one valid control cue present therein; wherein the valid control cue includes at least a first subject frequency of the persistent frequencies that is present for at least a first duration; communicating at least a first control effect signal to a sound effect circuitry in response to identification of the valid control cue; wherein the control effect signal causes the sound effect circuitry to alter at least one aspect of the audio signal; wherein the step of analyzing the persistent frequencies to determine if at least one predefined control cue is present therein includes comparing at least one later in time of the persistent frequencies to at least one earlier in time of the persistent frequencies.

In some embodiments the first control effect signal is dependent upon the magnitude of the difference between the at least one later in time of the persistent frequencies and the at least one earlier in time of the persistent frequencies.

As described herein, in other aspects other apparatuses and methods are provided for generating effects based on analysis of an audio signal.

The term "controller" is used herein generally to describe various apparatus relating to the analysis of one or more audio signals and/or the generation of one or more control effect signals for an effect generating device. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, digital signal controllers (DSCs), conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., an effect generating device, a control panel for one or more effect generating devices, a controller or processor associated with one or more effect generating devices or control panels, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead being placed upon illustrating the principles of the invention.

DETAILED DESCRIPTION

In the following detailed description, for purposes of explanation and not limitation, representative embodiments disclosing specific details are set forth in order to provide a thorough understanding of the claimed invention. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the claimed invention. For example, for illustrative purposes, the claimed invention may be discussed herein in conjunction with a guitar and certain effect generating devices. However, one of ordinary skill in the art having had the benefit of the present disclosure will recognize that the claimed invention may be utilized in combination with other instruments and other effect generating devices.

Figure 1:
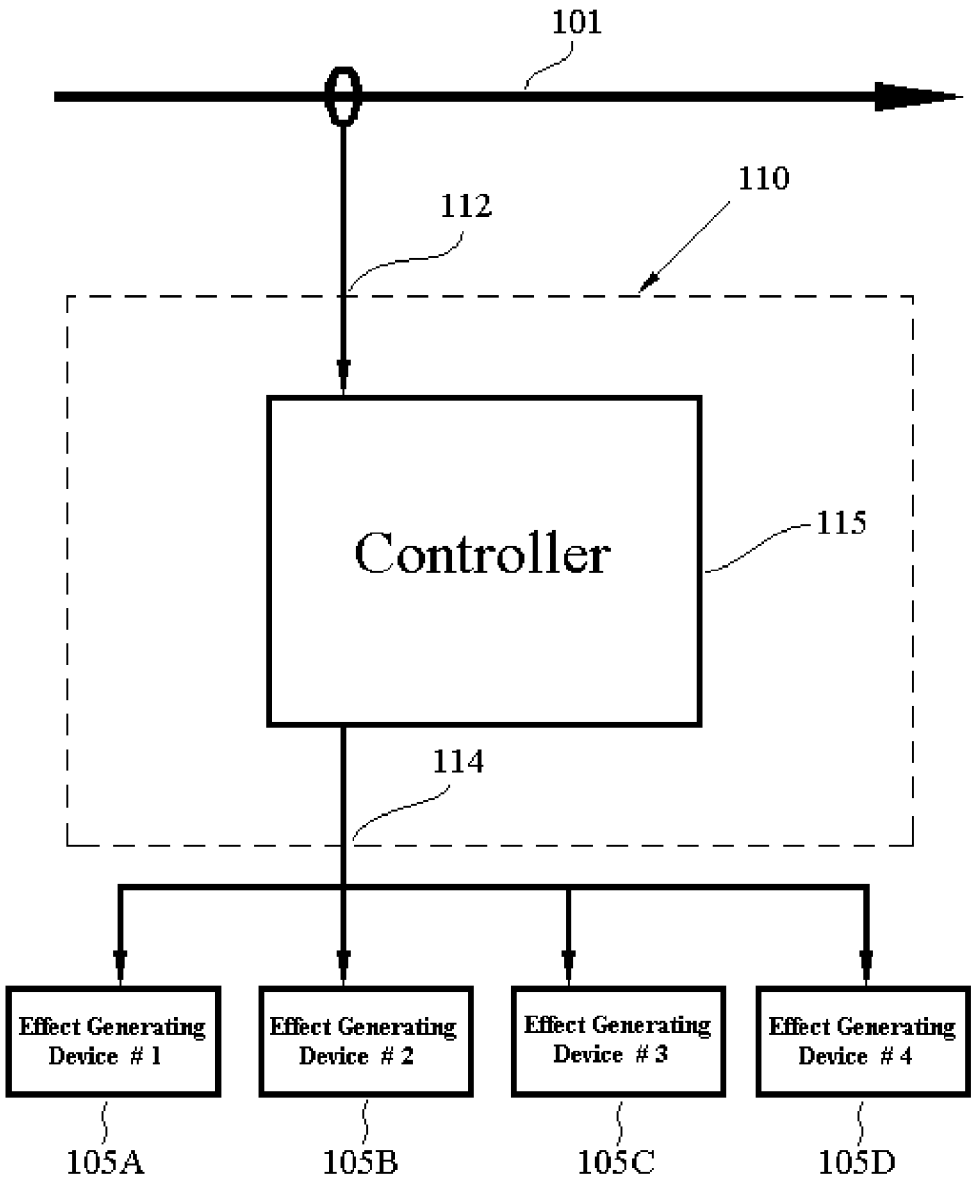
FIG. 1 illustrates a block diagram of an embodiment of an apparatus for generating effects based on audio signal analysis; the apparatus is shown electrically coupled to an audio signal and electrically coupled to a plurality of effect generating devices.

Referring to FIG. 1, in one embodiment, an apparatus for generating effects based on audio signal analysis 110 is shown electrically coupled to an audio signal 101 and electrically coupled to a plurality of effect generating devices 105A-D. Generally speaking, the apparatus 110 monitors and analyzes the audio signal 101 to recognize any embedded control cues that may be present in the audio signal. For example, the apparatus 110 may monitor a waveform of the audio signal 101 for the presence of a user generated playing technique or imbedded control cue. A controller 115 of the apparatus 110 may recognize such a control cue and generate and send one or more effect control cues to one or more of the effect generating devices 105A-D. For example, the controller 115 may recognize a series of chords in the audio signal 101, recognize the series of chords as a control cue, and generate and send one or more effect control cues to two of the effect generating devices 105A and 105B to thereby cause the effect generating devices 105A and 105B to generate one or more effects. For example, the effect generating device 105A may be a multi-color LED light array and may change to a predefined color based on a control effect signal sent thereto and the effect generating device 105B may be a pyrotechnic device that may be activated based on a control effect signal sent thereto.

The apparatus 110 is electrically coupled to the audio signal 101 at audio signal input 112 and is electrically coupled to the effect generating devices 105A-D at effect control output 114. In some embodiments the audio signal input 112 and/or the effect control output 114 may be conventional wired audio signal inputs/outputs. In alternative embodiments the audio signal input and/or the effect control output may be any other type of input/output for receiving audio signal and/or transmitting effects data, including wired and wireless inputs/outputs. For example, in some embodiments the audio signal input 112 and/or the effects control output 114 may be adapted to receive/send data over other physical medium, including, for example, twisted pair coaxial cables, fiber optics, or over a wireless link using, for example, infrared, microwave, or encoded visible light transmissions and any suitable transmitters, receivers or transceivers may be used to effectuate such communication. Any suitable protocol may be used for data transmission, including, for example, TCP/IP, variations of Ethernet, Universal Serial Bus, Bluetooth, FireWire, Zigbee, DMX, 802.11b, 802.11a, 802.11g, token ring, a token bus, serial bus, or any other suitable wireless or wired protocol. The apparatus 10 may also use combinations of physical media and/or data protocols. In some embodiments multiple audio signal inputs 112 and/or multiple effects control outputs 114 may be provided. The apparatus 10 may receive multiple audio signals via individual closed connections and/or one or more open network connections and/or may send effect control cues to a plurality of effect generating devices via multiple closed connections and/or one or more open network connections.

Figure 2A:
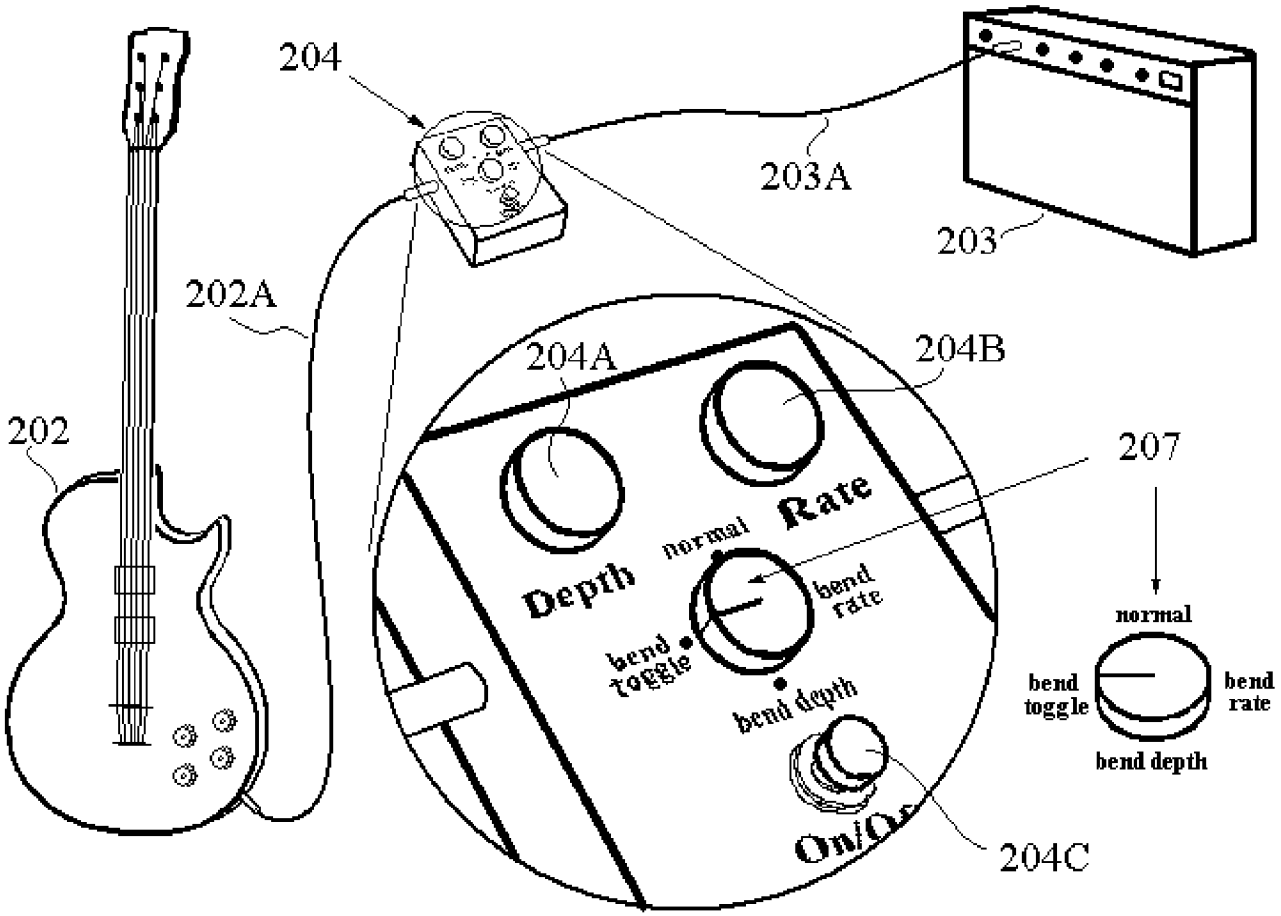
FIG. 2A illustrates a second embodiment of an apparatus for generating effects based on audio signal analysis; the second embodiment of the apparatus is shown electrically coupled to a guitar and electrically coupled to an amplifier.
Figure 2B:
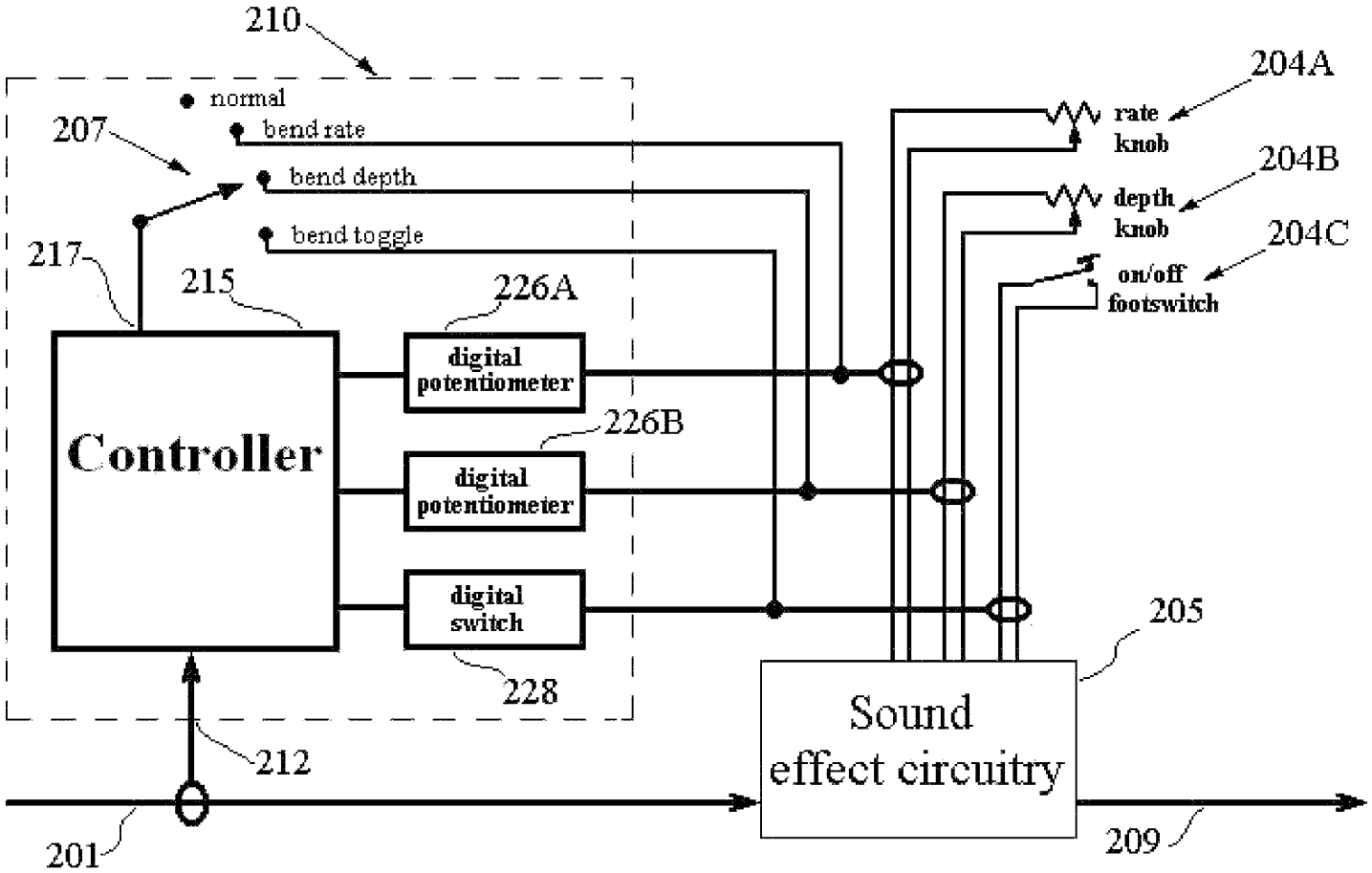
FIG. 2B illustrates a schematic diagram of the second embodiment of the apparatus of FIG. 2A; the apparatus is shown electrically coupled to effect generating sound effect circuitry.
Figure 2C:
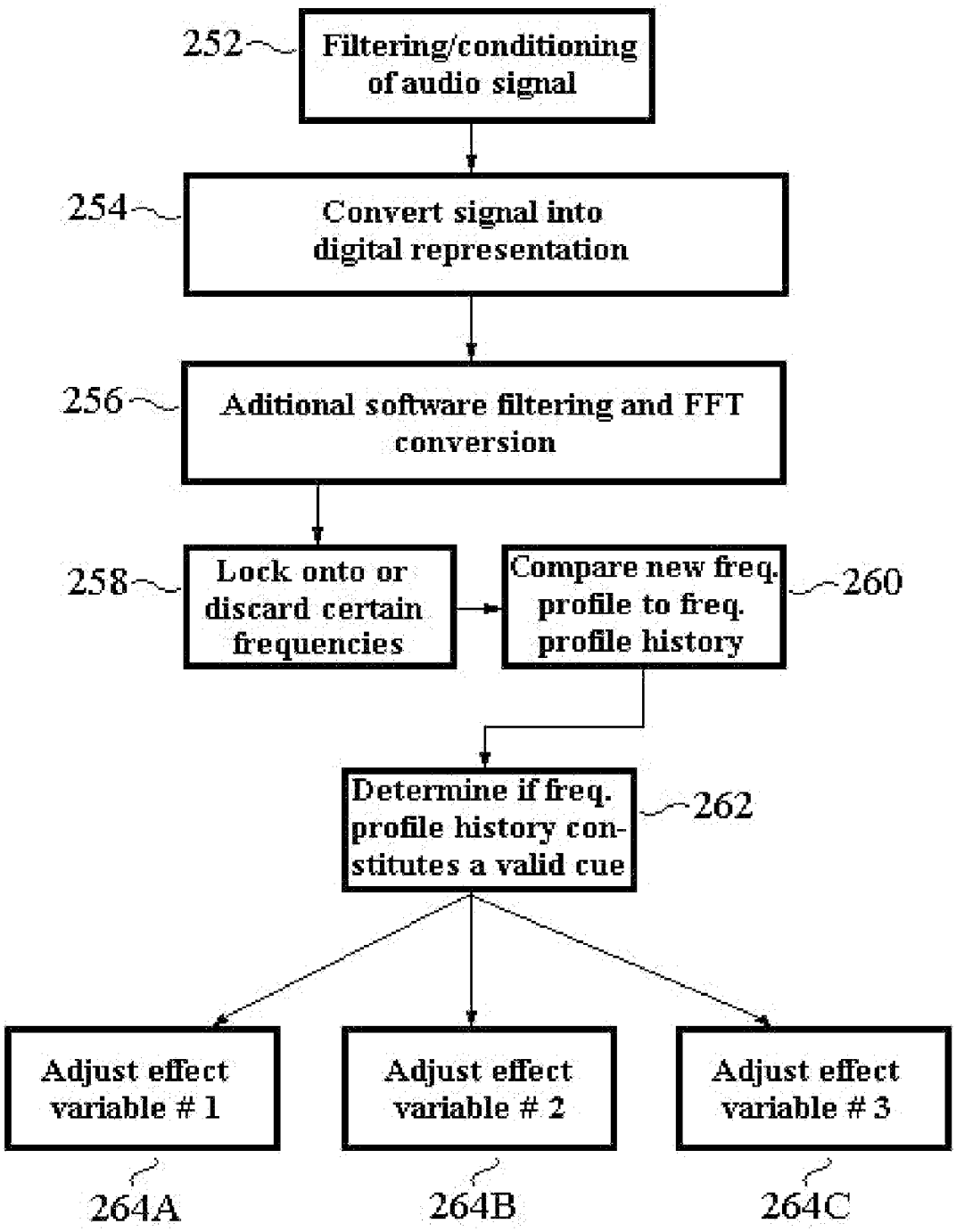
FIG. 2C illustrates a flow chart of the generalized logic of a controller of the second embodiment of the apparatus of FIG. 2A.

Referring now to FIGS. 2A-2C, various aspects of a second embodiment of an apparatus for generating effects based on audio signal analysis 210 are described. In FIG. 2A-2C the apparatus 210 is integrated within an "effects pedal" 204 having sound effect circuitry 205 therein. The sound effects generating circuitry may, inter alia, mix the incoming audio signal 201 (user supplied signal) with a delayed or pitch-modified copy of itself, the mixing of which is modulated by a low frequency oscillator giving the output signal a "wave" or a "wobble" effect overlaid on the original signal. Accordingly, in the second embodiment, the apparatus 210 and the effect generating device (the sound effect circuitry 205) are integrated within the same physical encasement. However, as described herein, other embodiments of the apparatus 210 may additionally or alternatively generate effect control cues for effect generating devices that are physically separate from and potentially remote from the apparatus 210. Also, in FIG. 2A-2C the effect generating circuitry 205 produces an effect directly on the audio signal that is supplied to the apparatus 210. However, as described herein, other embodiments of the apparatus 210 may additionally or alternatively generate effect control cues for effect generating devices that affect some non-audio signal related parameter such as, for example, lighting effects, other visual effects, and/or recording device control. In alternative embodiments other mechanisms for manipulating an audio signal besides effect generating circuitry 205 may be provided. For example, mechanisms that additionally or alternatively manipulate other aspects of an audio signal may be provided.

In FIG. 2A the effects pedal 204 is electrically coupled to an electric guitar 202 via wiring 202A and is also electrically coupled to an amplifier 203 via wiring 203A. The effects pedal 204 may deliver a single audio effect called a "chorus" through manual actuation of three typical controls: depth adjustment knob 204A, rate adjustment knob 204B, and On/Off switch 204C. Generally, speaking the depth adjustment knob 204A controls the extent to which a modulated signal is mixed with an incoming audio signal, or more prosaically, how dramatic or subtle the chorus effect is on the overall signal. The rate adjustment knob 204B controls the rate of the low frequency oscillator that controls the mix modulation, or more prosaically put, controls the warble of the chorus ranging from a very slow "wave" sensation to the ears (e.g., as low as 0.1 Hz) up to a very fast "wobble" audio sensation (e.g., up to 20 Hz). The On/Off switch 204C turns the functioning of the effects generating circuitry 202 on or off and resultantly determines whether the effects generating circuitry 202 modifies the audio signal. It is understood that, as described in additional detail herein, one or more of the manual controls 204A, 204B, and 204C may be omitted in alternative embodiments of the effects pedal 204 and the control of those one or more aspects may optionally be effectuated by virtue of the apparatus 210 alone.

As described, the manual controls 204A, 204B, and 204C and the sound effect circuitry 205 are typical in many effects pedals. However, the illustrated effects pedal 204 also includes a fourth control knob 207 that provides manual control for the extra functionality provided by the apparatus 210 as described herein. In alternative embodiments the control knob 207 could be omitted and the functionality thereof implemented by imbedded user control cues in the audio signal 201. In the embodiment of FIGS. 2A-C, three additional modes of operation are offered by the apparatus 210, but in alternative embodiments more or fewer modes of operation may be provided.

Referring to FIG. 2B, a schematic diagram of the apparatus 210 is shown in combination with a schematic diagram of the sound effect circuitry 205. The audio signal 201 is delivered to the audio signal input 212 of controller 215 via wiring 202A from electric guitar 202. The setting of the fourth control knob 207 is inputted to the controller 210 via a control knob input 217. The controller 215 is electrically coupled to and controls the resistance provided by digital potentiometers 226A and 226B and is also electrically coupled to and controls the on/off status of digital switch 228. In some embodiments the functionality of digital potentiometers 226A, 226B, and/or switch 228 may be implemented into controller 215. In the illustrated embodiment the fourth control knob 207 is a mechanical rotary switch that electrically intervenes between the sound effect circuitry 205 and the external controls 226A, 226B, 228, 204A, 204B, 204C, connecting the appropriate digital potentiometer 226A, 226B, or digital switch 228, in place of the corresponding manual control component, 204A, 204B or 204C.

In some alternative embodiments the fourth control knob 207 may be a potentiometer that delivers a variable resistance to control knob input 217 to determine mode, or a mechanical rotary switch or a digitally encoded rotary switch which delivers sufficient electrical state information to control knob input 217 for the controller 210 to determine the desired mode, or a simple push button switch to sequence through the available modes. In such embodiments, the fourth control knob 207 may only inform the controller of the desired function and not actually electrically intervene and select the manual control connections. In such embodiments the manual control components 204A, 204B and/or 204C may also be connected directly to the controller 210. In such embodiments, the controller 210 acts as both cue processor and manual control input port, leaving all sound effect variables to be asserted through the digital control components 226A, 226B, 228. Clearly, there are a number of ways to implement the basic circuitry to achieve identical functionality and the illustrated mechanical switch connection scheme is only one such way.

When the fourth control knob 207 is in the "bend depth" position, the digital potentiometer 226B is electrically connected to the sound effect circuitry 205 in place of the potentiometer associated with depth knob 204B. The other two manual controls 204A, 204C remain connected to the sound effect circuitry 205. Similarly, when the fourth control knob 207 is in the "bend rate" position, the digital potentiometer 226A is electrically connected to the sound effect circuitry 205 in place of the potentiometer associated with rate knob 204A. The other two manual controls 204B, 204C remain connected to the sound effect circuitry 205. Similarly, when the fourth control knob 207 is in the "bend toggle" position, the digital switch 228 is electrically connected to the sound effect circuitry 205 in place of the switch associated with On/Off switch 204C. The other two manual controls 204A, 204B remain connected to the sound effect circuitry 205. As described herein, one or more of the manual controls 205A-C may be omitted in some embodiments.

When the fourth control knob 207 is in the "normal" mode, the digital potentiometers 226A or 226B or the digital switch 228 do not affect the sound effect circuitry 205. Accordingly, in the normal mode the manual controls 205A-C control the sound effect circuitry. The remaining three additional dynamic modes ("bend rate," "bend depth," and "bend toggle") cause the apparatus 210 to selectively provide high-speed, real-time control cues to the sound effect circuitry 205 to thereby affect the sound of the output audio signal 209 that is supplied to amplifier 203 via wire 203A. As described herein, each of the three additional dynamic modes is activated in response to the controller 210 recognizing the "bend" guitar playing technique illustrated in FIG. 3B through analysis of the inputted audio signal 201. While many more potential modes of control may be implemented into the apparatus 210, these three modes are presented herein for brevity and clarity's sake and do not indicate the full range of operational capability of the apparatus 210.

Figure 3A:
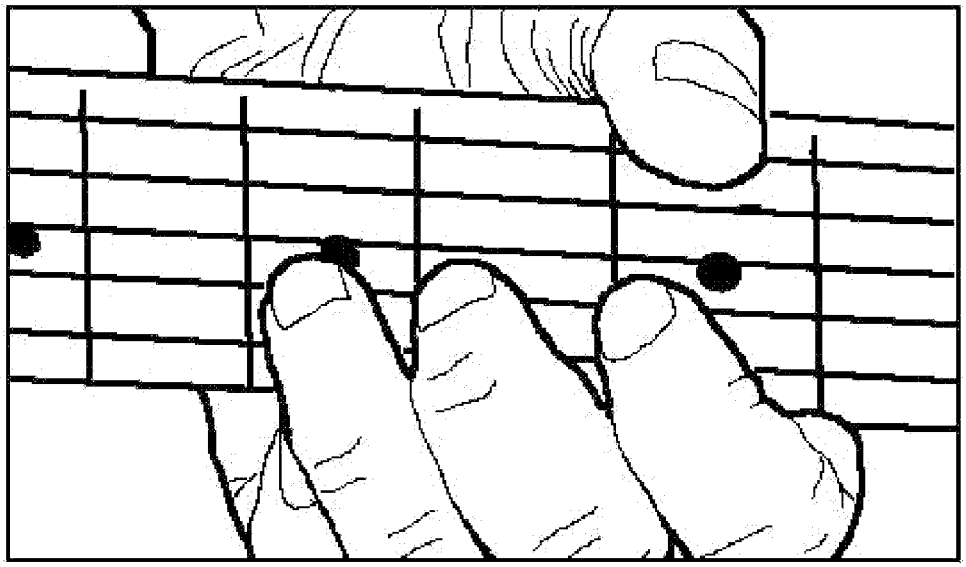
FIG. 3A illustrates guitar strings in the neutral position.
Figure 3B:
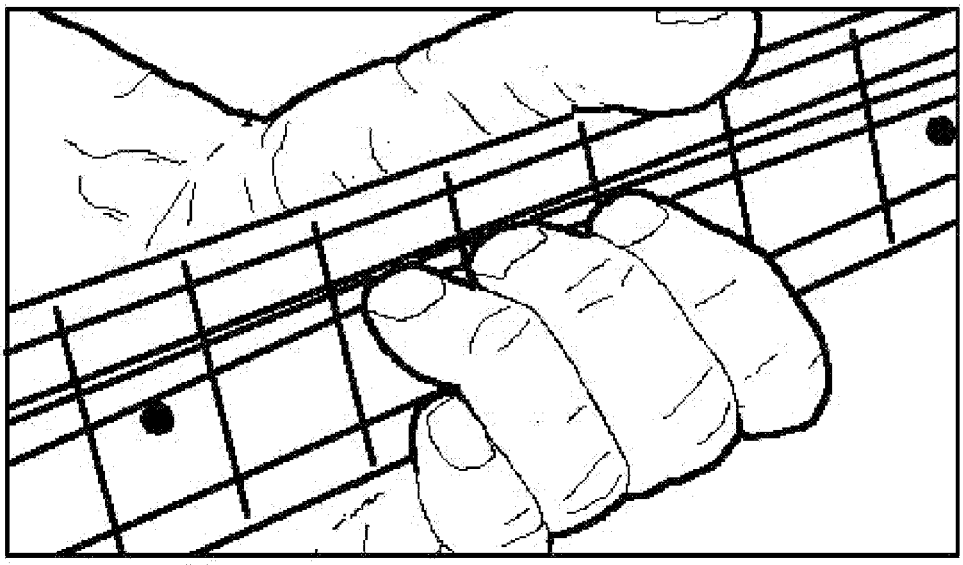
FIG. 3B illustrates guitar strings in the bend position.

The Bend Toggle Mode allows the user to replace the functionality of the manual switch 204C by "bending" the guitar string (for example, as shown in FIG. 3.) to toggle the chorus effect on and/or off with the digital switch 228. A first "bending" would toggle the chorus effect on and a subsequent "bending" would toggle the chorus effect off. It is common for players of the electric guitar to bend a string sideways across the fret board (as shown for example in FIG. 3B) in order to increase the tension in the string and thus raise the frequency of the note up to five half-steps and then relax the bend back to neutral position (as shown for example in FIG. 3A) to drop the note back down to the original frequency of the neutral position. The controller 210 monitors the frequency profile of the incoming guitar signal 201 supplied to input 212. The controller 210 recognizes a "bending" event when it detects an incoming frequency that gradually rises and then falls back though a continuous frequency range (rather than jumping discretely from one frequency to the next as normal note playing would generate). Such a bend occurrence would generate a frequency rise and fall of, for example, anywhere from 6% (a "half step", or the equivalent of one fret position on the guitar) to a maximum of 26% (4 half steps", or the equivalent of 4 fret positions). If the invention detects such a continuous, gradual frequency shift, it toggles the chorus effect on (if it is off) and off (if it is on). In this way the user can toggle the chorus effect on and off from the fret board of the guitar without any external referral to either the effects pedal or an external foot pedal.

The Bend Depth Mode allows the user to replace the functionality of the depth knob 204A by "bending" the guitar string (for example, as shown in FIG. 3.) to adjust the bend depth of the chorus effect via the digital potentiometer 226A. The controller 210 can monitor the incoming signal for a legitimate bend occurrence, and can correlate the intensity of the bend to the directed resistance level of the digital potentiometer 226A. For example, the practical maximum bend range of 26% of the neutral position frequency may be correlated to the full resistance range of digital potentiometer 226A to affect a resulting adjustment proportional to the relative range of the bend. Continuing the example, if the guitarist bends the string only a little, raising the pitch only 6% during the bend, then the controller 210 may only adjust the digital potentiometer 226A for depth control through approximately 25% of its full range, then drop the potentiometer 226A back to 0% as the guitarist relaxes the bend back to the neutral position. Accordingly, the bend technique can be recognized by the controller 210 and used as a dynamic surrogate for adjusting the depth control "up" and "down." That is, as the string is bent upwards, the controller 210 causes the resistance level of the digital potentiometer 226A to increase, thereby causing the sound effect circuitry 205 to increase the amplitude of the modulated signal that is mixed with the original signal (using the example of the chorus effect) for a more pronounced sound effect. Similarly, as the string is relaxed back to its normal position, the controller 210 causes the resistance level of the digital potentiometer 226A to decrease, thereby causing the sound effect circuitry 205 to decrease the amplitude of the modulated signal that is mixed with the original signal. It will be appreciated that the sound effect circuitry 205 may be configured such that an increase in the resistance of the digital potentiometer 226A may cause a decrease in the amplitude in the modulated signal and a decrease in the resistance of the digital potentiometer 226A may cause an increase in the amplitude of the modulated signal. Also, the relative correlation (sensitivity) between bend range and potentiometer range may be adjusted to players' tastes and abilities.

A similar process may occur in the Bend Rate Mode, only the rate of modulation of the delayed or pitch modified signal is varied with the bend of the string instead of varying the amplitude of the modulated signal. For example, the controller 210 can monitor the incoming audio signal for a legitimate bend occurrence, and can correlate the intensity of the bend to the directed resistance level of the digital potentiometer 226B to affect the "warble" rate of the chorus effect. Accordingly, the bend technique can be recognized by the controller 210 and used as a dynamic surrogate for adjusting the rate control "up" and "down." That is, as the string is bent upwards, the controller 210 may cause the resistance level of the digital potentiometer 226B to proportionally adjust in a first direction (increasing/decreasing the warble rate) and as the string is relaxed back to its normal position, the controller 210 may cause the resistance level of the digital potentiometer 226B to proportionally adjust in the opposite direction (decreasing/increasing the warble rate).

Again, while this description of the apparatus 210 is targeted to the electric guitar accessory market as an "effects pedal" effects unit, it can be applied to a broad range of input devices, signal recognition profiles, effect control options and audio applications. While it is illustrated that the control knob 207 may be actuated between the "bend rate," "bend depth," and "bend toggle" modes it will be appreciated that in some implementations the control knob 207 may be omitted. In some of those implementations a normal manual control mode may be selected via a first control cue (e.g., a first chord progression), a dynamic rate mode may be selected via a second control cue (e.g., a second chord progression) and controlled via another control cue (e.g., a bend), a depth mode may be selected via a third control cue (e.g., a third chord progression) and controlled via another control cue (e.g., a bend), etc.

Once a defined user cue (e.g., a bend) is detected and matched with its intended effect generating device (e.g., sound effect circuitry 205), the controller 210 causes the appropriate effect control cue to be sent out to the intended effect generating device through any one of an interface or communications ports of controller 210. For example, in the embodiment of FIG. 2B the controller 210 may cause the resistance of the digital potentiometer 226A to increase or decrease via electrical coupling thereto, thereby causing an appropriate effect control cue to be sent to the sound effect circuitry 205.

Turning now to FIG. 2C, a flowchart is provided showing an embodiment of the generalized process of sampling an audio signal, analyzing the audio signal for the presence of a user cue, and the generating of one or more effect control signals based on the presence of a user cue.

At step 252, the incoming audio signal is filtered and conditioned. For example, the incoming audio signal may be filtered and conditioned to eliminate undesired noise or ranges of frequencies. In some implementations of the apparatus 210 a high impedance, active, low-pass filter may be employed to eliminate high frequency noise and buffer the incoming audio signal 201. In some implementations the apparatus 210 may include a high gain pre-amplifier to boost low amplitude signals and an active multi-staged low-pass filter (in order to keep the Nyquist sample rate as low as possible and potentially saving processor time for more involved analysis). Most musical instruments or human vocal chords are limited to a maximum frequency of around 4000 Hz. As such, a minimum practical Nyquist sample rate of the user supplied signal may be 8000 Hz in some implementations. In such implementations any noise that ranges higher in frequency than 4000 Hz could show up as an unpredictable error in a Fourier transform of the sampled signal. Thus, an active, 2 to 3 stage, low-pass filter may be included in various implementations.

Monitoring the audio signal 201 for control cues may optionally implement one or more of a frequency to voltage converter, a comparator, an analog to digital converter. In some embodiments the analog to digital converter alone may be utilized to monitor the audio signal 201 for a control cue. However, other hardware and/or software may additionally or alternatively be utilized. For example, in some embodiments a microprocessor may be utilized to filter a properly sampled audio signal. Also, for example, a digital signal processor or various hardware schemes may be utilized to track the frequencies of the incoming signal via filtering algorithms like multiple band pass or multiple notch filtering or sweeping filter values across the audio signal's frequency range instead of using FFTs. In some embodiments the frequency profile may be acquired directly from a user supplied signal such as a MIDI signal.

At step 254, the incoming audio signal is converted into a digital representation. For example, the incoming analog audio signal may be converted into a digital representation using an analog to digital converter and/or a MIDI converter. Alternatively, the incoming audio signal may be supplied to the apparatus 210 in a satisfactory digital form, including MIDI. In an example implementation, after the analog audio signal is passed through an active low pass filter and amplified by a high gain op amp circuit, it may be sampled by an analog to digital converter at, for example, 8,000 samples per second (SPS) and stored as an array in controller RAM.

At step 256 one or more Fast Fourier transforms may be performed on all or various sections of the stored array and the transformed array stored in the controller RAM. Such transforms exhibit an array of binary values. The magnitudes of the individual elements of the array of binary values indicates the relative amplitude of a given frequency component and the element's position in the array indicates the frequency. Depending on the speed of the system, many overlapping transforms of the incoming digitized signal may be performed and stored to determine more conclusively the frequency content of a given section of the incoming signal. Subsequent analysis of a series of such transformed arrays may further be performed in the example implementation. Since most musical or voice information is a function of the relative frequency content of a signal over time, the overlapping Fourier transforms allow the controller to produce a periodic frequency snapshot of the audio signal (e.g., every 10 milliseconds or so).

At step 258 the controller, through analysis of the transformed array segments, (the frequency snap shots) may determine certain frequencies to be stable notes. After transforming a sufficient series of overlapping sections of the incoming digitized signal a frequency profile of the audio signal begins to develop (e.g., like a movie develops from single snapshots), allowing for the identification of persistent frequencies and/or frequency transitions (notes, chords). Once a frequency is identified as stable (of sufficient duration) its value is stored in controller RAM as a valid note in an array of valid notes recording the history of note detections. Over time, a history profile of notes, chords, and/or transitions (e.g., the absence of notes or chords) is assembled to analyze for user cues.

At step 260, it becomes possible to compare the current frequency (note) to the available frequency data history for certain minimum cue requirements. If the current frequency profile combines with the frequency history to pass certain analytical screening criteria, it is then ready to be compared to a library of predetermined frequency profiles of expected user cues stored in ROM or implied in program code.

Through comparison of the recently gathered frequency profiles to a library of possible user cues, user cues may be identified and processed for the proper control output criteria. User cues can include a variety of cues as described herein such as certain playing techniques, notes, chords, styles or other identifiable audio waveforms.

At step 262, it is determined if the frequency profile history matches any number of stored frequency profiles of possible user cues stored in RAM and/or ROM, it constitutes the detection of a valid user cue. For purposes of ease of discussion of certain embodiments of determining if the frequency profile history constitutes a valid user cue, several terms are generally defined herein. A "valid note" is a sustained frequency or frequency range detected in some minimum number of consecutive histograms. A "valid chord" is a sustained detection of two or more frequencies or frequency ranges in some minimum number of consecutive histograms. A "valid cue" is the detected occurrence of a pre-determined or user-defined set of notes or frequency profiles imbedded in the user supplied signal. A "control effect signal" is any number of digital and/or analog control signals delivered to one or more effect generating devices in response to a valid cue. The control effect signal may be delivered directly to the effect generating device or may be delivered to an effect controller that controls a plurality of effect generating devices.

At step 262 the controller also examines the frequency history to determine if one or more user cues are present in the audio signal stream. Provided hereinafter are a plurality of examples of determining if one or more user cues are present in the audio signal stream.

In some embodiments a user might play or sing a single note of a certain predetermined or user defined frequency, or falling in a pre-defined range of frequencies, for a certain duration that would be interpreted as a control cue. In such embodiments, a valid note of a specific predetermined or user defined frequency and duration recognized in the frequency history may be determined to be a valid user cue. In response to the valid cue the controller may cause an appropriate control effect signal to be output to one or more effect generating devices at steps 264A, 264B, and/or 264C. Accordingly, under such embodiments the content of an audio signal is scanned for a specific valid note and a control effect signal is generated upon recognition of the specific valid note.

In some embodiments the user might play or sing two or more simultaneous notes of a certain predetermined or user defined frequency for a certain minimum duration that would be intended as a valid cue. If a sufficient series of histograms exhibit the intended valid chord, then the cue is determined to be valid and the controller may cause an appropriate control effect signal to be output to one or more effect generating devices at steps 264A, 264B, and/or 264C.

In some embodiments the user might play or sing two or more simultaneous notes of a certain predetermined or user defined relative frequency (for example, the notes of all major $7^{th}$ chords have the same relative frequencies) and duration that would be intended as a control cue. If the histograms exhibit the intended valid chord with the appropriate relative frequencies, then a valid cue is detected and the controller may cause an appropriate control effect signal to be output to one or more effect generating devices at steps 264A, 264B, and/or 264C.

In some embodiments the user might play or sing two consecutive notes or chords of a predetermined or user defined specific interval to be intended as a control cue. If the histograms exhibit the specific interval a valid cue would be detected and the controller may cause an appropriate control effect signal to be output to one or more effect generating devices at steps 264A, 264B, and/or 264C.

In some embodiments the user might play or sing two consecutive notes or chords of a predetermined or user defined relative interval to be intended as a control cue. If the histograms exhibit the relative interval a valid cue would be detected and the controller may cause an appropriate control effect signal to be output to one or more effect generating devices at steps 264A, 264B, and/or 264C.

In some embodiment the user might employ a technique that would either continuously increase or decrease the frequency of a note or chord as a control cue. If the histograms exhibit the continual increase or decrease in the frequencies of a valid note or valid chord, a valid cue would be detected and the controller may cause an appropriate control effect signal to be output to one or more effect generating devices at steps 264A, 264B, and/or 264C.

In some embodiments the user might play or sing a note or chord for a certain duration during which the volume is increased or decreased continuously. If the histograms exhibit the continual increase or decrease in global magnitude of all frequencies, a valid cue would be detected and the controller may cause an appropriate control effect signal to be output to one or more effect generating devices at steps 264A, 264B, and/or 264C.

In some embodiments the user might stop playing and the lack of frequencies for a certain duration. If the histograms exhibit a sufficient period of the absence of frequencies a valid cue would be detected and the controller may cause an appropriate control effect signal to be output to one or more effect generating devices at steps 264A, 264B, and/or 264C.

In some embodiments the user might stop producing notes or sounds and the lack of frequencies for a certain duration after or before or between two frequency profiles (notes or chords). If the histograms exhibit a sufficient period of the absence of frequencies after or before or between two frequency profiles a valid cue would be detected and the controller may cause an appropriate control effect signal to be output to one or more effect generating devices at steps 264A, 264B, and/or 264C.

It is evident that the user may intend any combination or sequence or repetition of the above list of control cues as a separate control cue. Also, in some embodiments, voice recognition algorithms can be combined with the FFT algorithms or other frequency profile or frequency histogram producing techniques to allow the detection of practically any waveform imaginable as a user cue. The variety and scope of all possible user cues is beyond the scope of the written description. The number of playing techniques, noise profiles, vocal techniques, vocal commands, vocal frequency profiles, vocal noise profiles, intentional noise, etc. are voluminous and are not all delineated herein for purposes of conciseness. However, one of ordinary skill in the art, having had the benefit of the present disclosure, will recognize other such user control cues that may be utilized.

Figure 4:
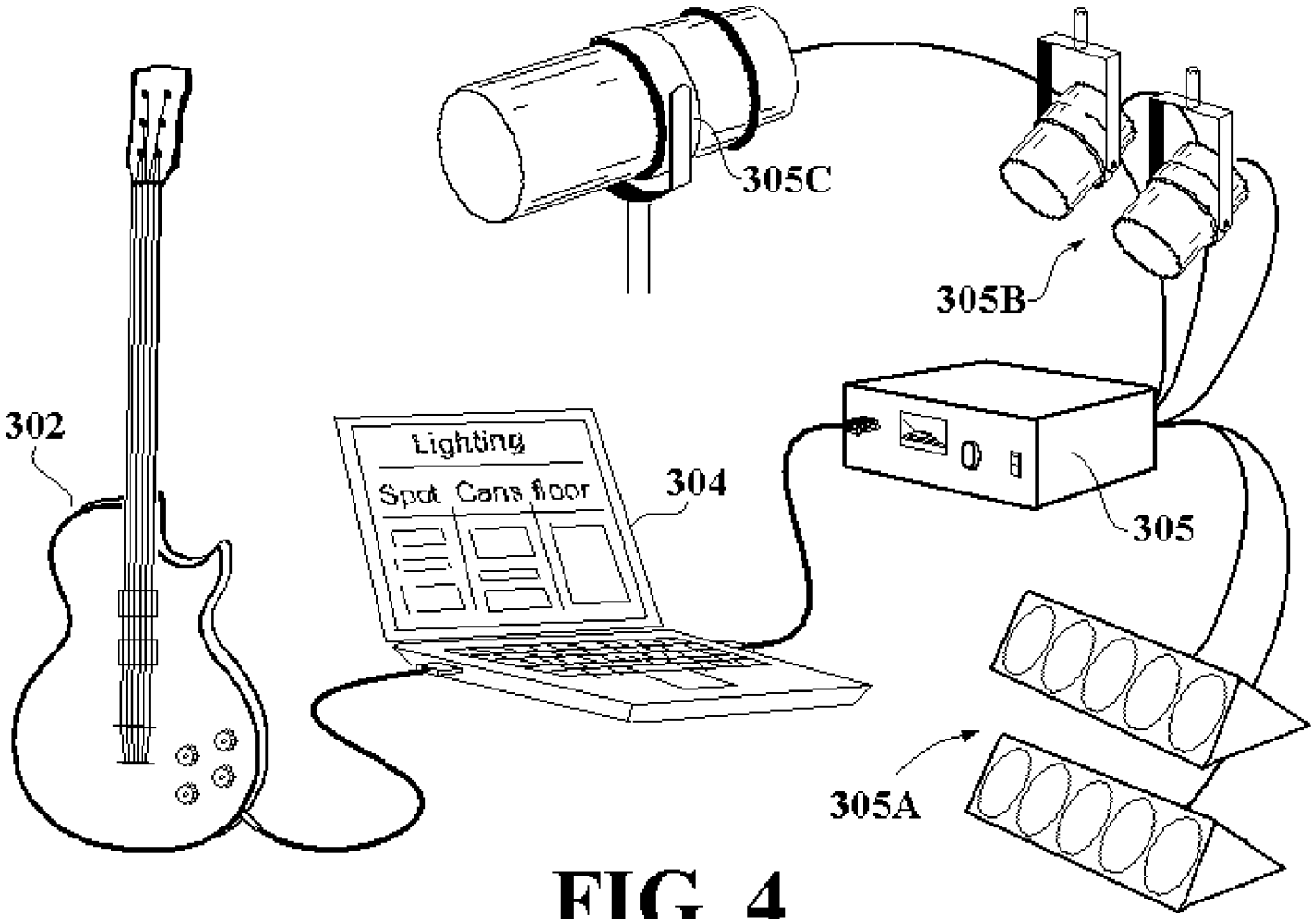
FIG. 4 illustrates a third embodiment of an apparatus for generating effects based on audio signal analysis; the third embodiment of the apparatus is shown electrically coupled to a guitar and electrically coupled to a plurality of effect generating devices.

Referring now to FIG. 4, a computer 304 is illustrated electrically coupled to an electric guitar 302 and electrically coupled to a master controller 305 that controls a plurality of lights 305A, 305B, and 305C. The computer 304 is a special purpose computer having software and/or hardware that enables the computer 304 to receive and filter the audio signal from the electric guitar 302 and analyze the audio signal for the presence of a control cue. Moreover, the computer has software and/or hardware that enables the computer to communicate effect control cues to the master controller 305. The computer 304 may be programmed by a user to recognize certain desired control cues and generate desired effect control cues to the peripheral master controller 305 according to one or more aspects described herein.

The apparatuses and methods described herein enable a musician, singer, and/or recording enthusiast to control in real time any number of peripheral systems, devices and effects via a wide array of playing styles, note choices or pre-selected "cues" that are imbedded in the user supplied or generated audio signal. In this way, a singer is, for example, able to invoke a robotic spotlight to be directed on her face every time he/she sings a certain high note or every time the vibrato in his/her voice exceeds a certain minimum amplitude. Also, for example, utilizing the apparatuses and method described herein may enable a rock guitarist to set off some upstage pyrotechnic effect every time he plays a certain chord on his guitar. The apparatuses and methods described herein may remove the necessity of timing of one or more external effects and/or manual actuation of one or more external effects by an artist or other individual.

The apparatuses and methods described herein may provide an increase in peripheral control with very minimal distraction from performance or recording sessions and/or may expand a performer's artistic repertoire to include peripheral devices as part of the performance art. The apparatuses and methods enable a user to select some innocuous or ubiquitous musical or audio cue that can be employed as a signal-based method by which to control an operational aspect of a related system. The automatic cue detection and control response capabilities provide the user real-time control over a wide range of devices and systems. Moreover, the apparatuses may be configured (either at the factory or by user interface) to identify any differentiable waveform that the user can produce to control any peripheral device the user might like to control with as little distraction or delay as desired. Moreover, the apparatuses may enable a user to actually "play" the peripheral system as a part of their artistic repertoire. The user not only has a voice or instrument to express their art and talent, they additionally have visual, video, and/or audio effects that they can control and invoke with the same facility as the parameters of their voice or instrument. The effect generating devices may thus become part of the performance art.

As described herein, embodiments of the apparatus may provide functionality with a number of audio generating objects such as, for example, electric guitar, electric bass, electric plano, voice or ambient sound that has been electrically detected or converted, any microphone or piezo-electric pickup, any audio signal from any electrical device or system, any demodulated or digitized signal from broadcast, cable or satellite, LAN, WAN, or Internet, or computer generated signal. Generally speaking, any signal that is in the audio range or can be converted into the audio range or into an audio signal can be monitored and parsed for control parameters according to aspects of the method and apparatus described herein.

Also, the list of possible control cues may be based on, for example, instrument specific playing techniques, user specific playing techniques, instrument-specific frequency profiles, instrument specific noise profiles, user specific noise profiles, absolute frequencies, specific frequencies, specific frequency combinations, specific frequency intervals, relative frequencies, relative frequency combinations, relative frequency intervals, frequency ramping, specific amplitude levels, amplitude ramping, vocal techniques, vocal commands, vocal frequency profiles, vocal noise profiles, intentional noise, user defined frequency profiles, the absence of any of the above cues for a given interval, silence, relative amplitudes for a given interval, high amplitude, the combination of any of the aforementioned cues, and sequences of any of the aforementioned cues.

Also, the list of possible effect generating devices may include, for example, devices that alter audio effects such as amplification, overdrive, distortion, tremolo, phase shifting, chorus, flanger, compression, volume, equalizer, tone loading (wah-wah), compression, noise filtering, tone generators, music synthesizers, midi devices; recording or storage devices, such as computers, tape decks, jump drives, mp3 players, etc; stage or performance enhancing devices such as lighting, pyrotechnics, special visual effects, mechanical effects, video systems, etc.; and/or any electrically effectible device, system, feature, aspect, object, or property that might prove desirable to control in response to a user embedded cue in an audio signal.

Thus, while several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. An effects pedal, comprising:

at least one audio signal input;

a controller electrically coupled to said audio signal input, said controller including a control effect signal output, at least one control cue, and at least one control effect signal correlated to said control cue;

a sound effect circuit electrically coupled to said at least one audio signal input and electrically coupled to said control effect signal output, said sound effect circuit including an audio signal output;

wherein said controller is operable to transform an audio signal received over said audio signal input into a frequency array, wherein said frequency array is indicative of frequency content of said audio signal over a period of time;

wherein said controller is further operable to identify a plurality of persistent frequencies present within said frequency array and compare at least one later in time of said persistent frequencies to at least one earlier in time of said persistent frequencies to determine if said control cue is present in said audio signal;

wherein said controller communicates said control effect signal over said control effect signal output in response to identification of said control cue;

wherein communication of said control effect signal over said control effect signal output causes said sound effect circuit to manipulate at least one aspect of said audio signal, thereby generating a manipulated audio signal, and to output said manipulated audio signal to said audio signal output.

2. The effects pedal of claim 1, wherein said control effect signal comprises a variable resistance.

3. The effects pedal of claim 1, further comprising a potentiometer electrically interposed between said control effect signal output and said sound effect circuit, wherein a resistance of said potentiometer is dependent on said control effect signal.

4. The effects pedal of claim 3, wherein said control effect signal comprises a variable digital output.

5. The effects pedal of claim 3, wherein said at least one aspect of said audio signal includes the rate of the chorus of said audio signal.

6. The effects pedal of claim 1, wherein said control effect signal is dependent upon the magnitude of the difference between at least one later in time of said persistent frequencies and at least one earlier in time of said persistent frequencies.

7. The effects pedal of claim 6, wherein the extent of manipulation of said at least one aspect of said audio signal by said sound effect circuit is dependent on said magnitude difference between said at least one later in time of said persistent frequencies and said at least one earlier in time of said persistent frequencies.

8. The effects pedal of claim 1, wherein said control cue includes at least a first frequency component.

9. The effects pedal of claim 8, wherein said control cue further includes a second frequency component.

10. The effects pedal of claim 1, wherein said control cue includes a lack of frequency component.

11. An effects pedal, comprising:

at least one audio signal input;

a controller electrically coupled to said audio signal input, said controller including at least one control effect signal output, at least one control cue, and at least one control effect signal correlated to said control cue;

wherein said control cue includes at least one frequency;

a sound effect circuit electrically coupled to said at least one audio signal input and electrically coupled to said control effect signal output, said sound effect circuit including an audio signal output;

wherein said controller is operable to analyze an audio signal received over said audio signal input to identify if said control cue is present in said audio signal;

wherein said controller communicates said control effect signal over said control effect signal output in response to identification of said control cue;

wherein communication of said control effect signal over said control effect signal output causes said sound effect circuit to manipulate at least one aspect of said audio signal, thereby generating a manipulated audio signal, and to output said manipulated audio signal to said audio signal output;

wherein said at least one aspect of said audio signal includes at least one of rate and depth of the chorus of said audio signal.

12. The effects pedal of claim 11, wherein said controller and said sound effect circuit are contained in a common electrical component.

13. The effects pedal of claim 11, further comprising a user interface having at least a first position and a second position, wherein in said first position said first control effect signal is output over said control effect signal output in response to said control cue, and wherein in said second position a second control effect signal is output by said controller in response to at least one of said control cue and a second control cue of said at least one control cue.

14. The effects pedal of claim 13, wherein in said second position said second control effect signal is output over a second control effect signal output of said controller, said second control effect signal output in electrical communication with said sound effect circuitry.

15. The effects pedal of claim 14, wherein communication of said second control effect signal over said second control effect signal output causes said sound effect circuit to manipulate a second aspect of said at least one aspect of said audio signal.

16. The effects pedal of claim 11, further comprising a first digital potentiometer electrically interposed between said control effect signal output and said sound effect circuitry.

17. The effects pedal of claim 11, further comprising a manually adjustable knob coupled to a manually adjustable potentiometer, said manually adjustable potentiometer selectively electrically coupled to said sound effect circuitry to thereby enable manual manipulation of said audio signal.

18. The effects pedal of claim 17, further comprising a manually adjustable effects knob electrically coupled to said manually adjustable potentiometer and said sound effect circuitry, said manually adjustable effects knob selectively electrically disconnecting said manually adjustable potentiometer from said sound effect circuitry.

19. An effects pedal, comprising:

at least one audio signal input;

a controller electrically coupled to said audio signal input, said controller including at least one control effect signal output, at least one control cue, and at least one control effect signal correlated to said control cue;

wherein said control cue includes at least one frequency;

a sound effect circuit electrically coupled to said at least one audio signal input and electrically coupled to said control effect signal output, said sound effect circuit including an audio signal output;

wherein said controller includes means for analyzing an audio signal received over said audio signal input to identify if said control cue is present in said audio signal;

wherein said controller communicates said control effect signal over said control effect signal output in response to identification of said control cue;

wherein communication of said control effect signal over said control effect signal output causes means for manipulating an audio signal to manipulate at least one aspect of said audio signal, thereby generating a manipulated audio signal, and to output said manipulated audio signal to said audio signal output;

wherein said at least one aspect of said audio signal includes at least one of rate and depth of the chorus of said audio signal.

* * * * *